United States Patent [19]

Goodin

[11] Patent Number: 4,472,856

[45] Date of Patent: Sep. 25, 1984

[54] PIVOTED DUCT CONVERSION

[75] Inventor: Carl W. Goodin, North Canton, Ohio

[73] Assignee: The Hoover Company, North Canton, Ohio

[21] Appl. No.: 462,565

[22] Filed: Jan. 31, 1983

[51] Int. Cl.[3] ..... A47L 5/32

[52] U.S. Cl. ..... 15/337

[58] Field of Search ..... 15/331–337, 15/416, 417, 339

[56] References Cited

U.S. PATENT DOCUMENTS

| | | | |
|---|---|---|---|
| 2,142,978 | 1/1939 | Eriksson-Jons | 15/416 |
| 2,372,033 | 3/1945 | Taylor | 15/333 |
| 2,876,481 | 3/1959 | Gerber et al. | 15/331 |
| 2,953,808 | 9/1960 | Carmack | 15/416 X |
| 3,869,751 | 3/1975 | Boyd et al. | 15/334 |
| 4,219,900 | 9/1980 | Dyer | 15/339 |

*Primary Examiner*—Chris K. Moore

*Attorney, Agent, or Firm*—Gerald H. Kreske; Richardson B. Farley

[57] ABSTRACT

An upright cleaner or the like is provided with a pivoting duct that pivots outwardly of the hood of the cleaner for attachment of a conversion tool. This permits conversion of the upright cleaner to, for example, hose operation.

5 Claims, 8 Drawing Figures

PIVOTED DUCT CONVERSION

BACKGROUND OF THE INVENTION

1. Field of the Invention

This invention relates to cleaner conversion and, more particularly, relates to conversion through the cleaner hood by the use of a pivoted duct.

2. Description of the Prior Art

It is known to provide ingress of a conversion tool through an upright cleaner hood or the like by the use of a trap door or similar mechanism to engage inwardly with a duct, but no one heretofore to Applicant's knowledge has utilized a pivoted duct, pivoting out of the cleaner hood, for telescopic engagement with the conversion tool. Since such an arrangement obviously aids in alignment of the tool with suction duct such an arrangement would be advantageous.

Accordingly, it is an object of the instant invention to include a duct to converter tool conversion in an upright cleaner or the like.

It is an additional object of the invention to provide a pivoted duct for purposes of conversion attachment.

It is a still further object of the invention to provide a pivoted duct in an upright cleaner hood or the like which pivots outwardly of the hood for converter tool connection.

SUMMARY OF THE INVENTION

The invention comprehends a hooded upright cleaner having a duct which pivots outwardly of the hood so as to provide an open end which may be telescopically connected to a conversion tool. The duct pivots at its rear at the motor fan system so as to be in confluent communication with it, with a pair of seals preventing air leakage. At its front, the duct mates with the duct piece extending rearwardly from the cleaner suction opening, this piece being angled on its rearward end to permit the like forward oppositely angled end of the pivoted duct to swingingly mate with it when the pivoted duct was in its nested position.

The pivoted duct, on its top side, is configured so as to lie substantially flush with the top of the hood, and is at least partly maintained in this position by a gasket attached to the duct piece and tending to embrace the forward end of the pivoted duct inwardly. This gasketing may also be utilized between the duct piece and the pivoted duct to insure sealing at this location.

DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
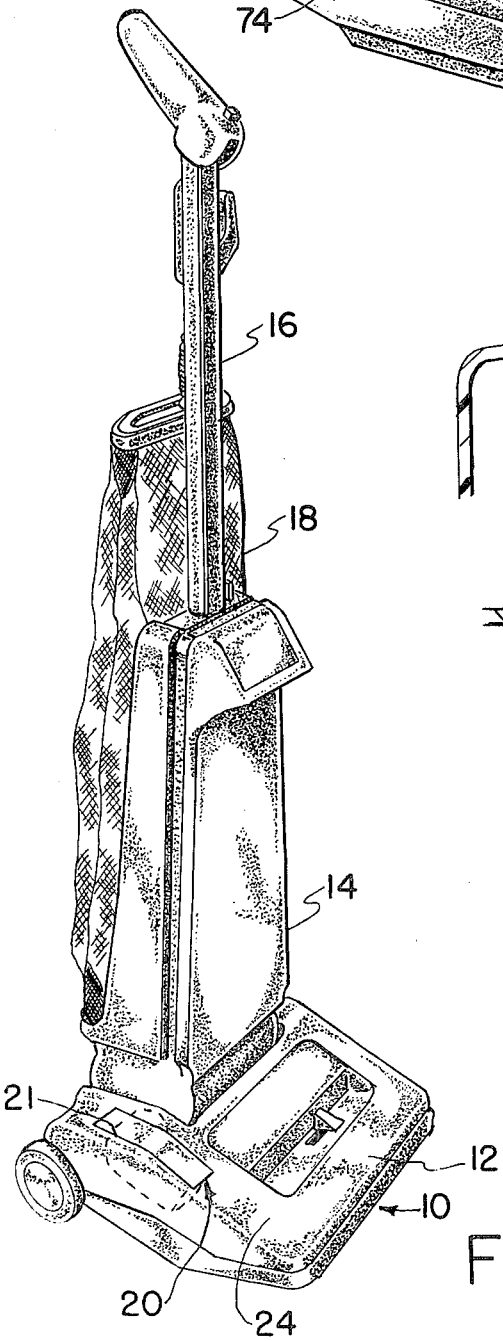
FIG. 1 is a perspective view of an upright cleaner or the like that incorporates the invention.

There is shown in FIG. 1, a cleaner 10 having a hood 12, a rigid housing 14, extending upwardly from the hood 12 and a handle 16 attached to upper reaches of the rigid housing 14. A bag 18 is suspended from the handle and attaches to lower reaches of the rigid housing 14. Insofar as related the cleaner 10 is substantially conventional.

Figure 2:
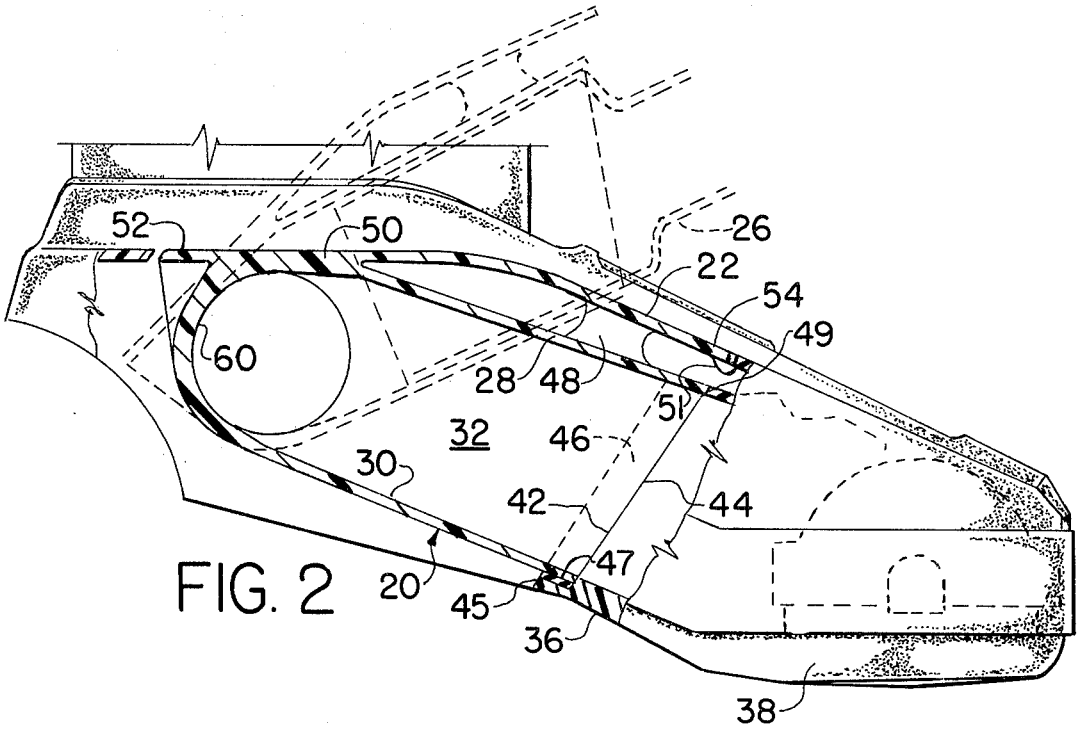
FIG. 2 is a cross sectional side elevation of the pivoting duct contained in FIG. 1.

A pivoted duct 20 is shown in closed position within an opening 21 so as to be pivotable from a position in which its top 22 is flush with a top surface 24 of the hood 12 to a position outwardly of the hood for the reception of a converter tool 26 (FIG. 2) which may take the form of an end coupling on a hose or the like, the same providing conversion from on the floor to hose operation similarly to a canister cleaner configuration.

Figure 3:
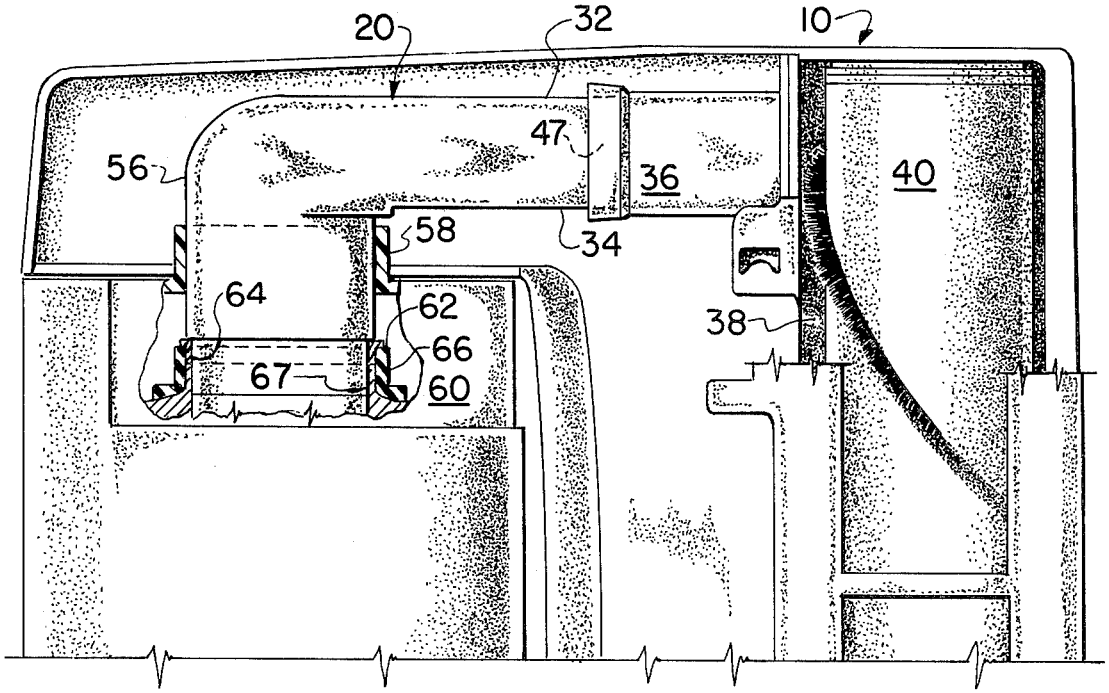
FIG. 3 is a bottom partial plan view, partly broken away, showing the pivoting duct and ancilliary structure.

The flow area of the duct 20 is generally of closed configuration in cross section having a top wall 28, a bottom wall 30 and side walls 32, 34 and extends generally linearly along the hood to confluently communicate with a forward fixed duct piece 36 under the forward reaches of the hood 12. The fixed duct piece 36 communicates with a suction opening 38 (FIG. 3) at its forward end, with the suction opening 38 lodging a conventional agitator 40.

The abutting end 42 of the pivoting duct 20 and internal lip 44 on the fixed forward duct 36, respectively, are opposite angled or slanted to permit close abutment upon downward swinging of the pivoted duct 20 but still permitting such swinging with unobstructive interference between these ends. A gasket seal 46 extends completely around three sides of the forward duct 36, as does the lip 44, forming an open U-shape in cross section and leaving an opening at its top to prevent obtrusion of the gasket 46 into the volume swept by the swinging of pivoting duct 20. The gasket 46 nests in an enlarged section 47 of fixed forward duct 36. The gasket 46 extends to the end 45 of fixed forward duct 36 and then forwardly to overlap the end of pivoting duct 20 when the same is in close abutting confluent relationship with the fixed forward duct 36, with the gasket 46 providing a downward stop for the swinging of pivoted duct 20 and an embracement means for holding the pivoting duct 20 in its flush position as shown in FIG. 1. The upper end of pivoted duct 20, the forward end of top wall 28, engages against the rearward end of a top wall 49 of forward duct 36 to limit leakage in this area. A nib 51 also provides a snap engagement for the pivoted duct 20.

Pivoted duct 20, as before indicated, includes a top 22 which surmounts the top wall 28 and is spaced from it near its forward end by a rib 48. The top 22 extends rearwardly of this rib and merges with top wall 28 to provide a thickened portion 50 to the pivoted duct 20. Rearwardly of this thickened portion the top 22 includes a cantilevered leaf portion 52, rearwardly of thickened portion 50, that extends sufficiently rearwardly to close the rear of opening 21. At the front of opening 21, top 22 also includes another forwardly extending leaf 54 that closes the front of opening 21. The cantilevered leaf portion may be depressed downwardly by finger pressure to initiate pivoting of the duct 20.

Pivoted duct 20 includes an integral angled portion 56, bent at right angles to the rest of pivoted duct 20, that provides for its pivoting. Angled portion 56 is circular in cross-section and extends through a boss 58 formed in a motor-fan housing 60 for the cleaner 10, for bearing and sealing movement relative to the motor housing 60. Inwardly of the boss 58, the angled portion 56 is generally reduced in diameter to provide a shoulder 62 against which rides a seal member 64 that also conforms to the reduced diameter of angled portion 56. The seal member 64 is held in place by a resilient sleeve 66 that envelopes its circular periphery and, in turn, embraces a portion 67 of motor housing 60. It should be obvious, then, that the angled portion 56 of pivoted duct 20 can thereby rotate within seal 64 with little leakage and yet with ease to facilitate pivoting of the pivoted duct 20.

Like numbers are utilized in the remaining Figures for like parts while similar but differing parts are primed, double primed, or triple primed, depending on whether the second, third, or fourth species.

Figure 4:
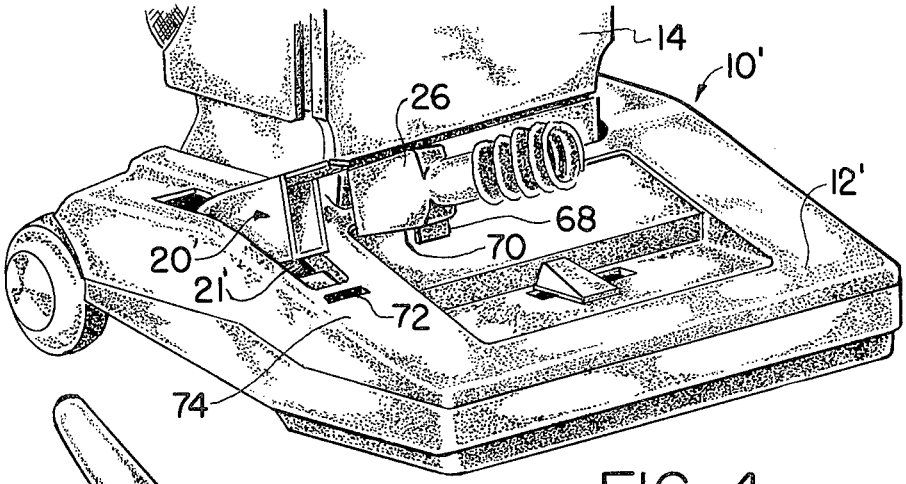
FIG. 4 is a partial perspective view of cleaner including a second embodiment of the invention.
Figure 7:
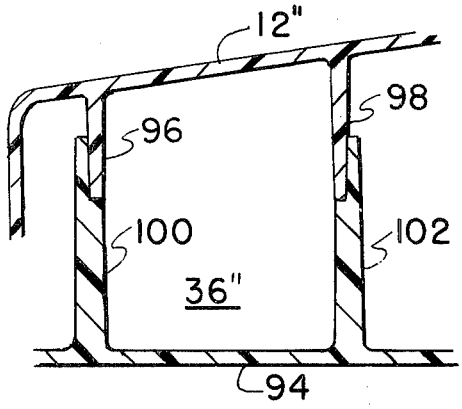
FIG. 7 is a partial cross sectional elevational view taken on line 7—7 of FIG. 6.
Figure 5:
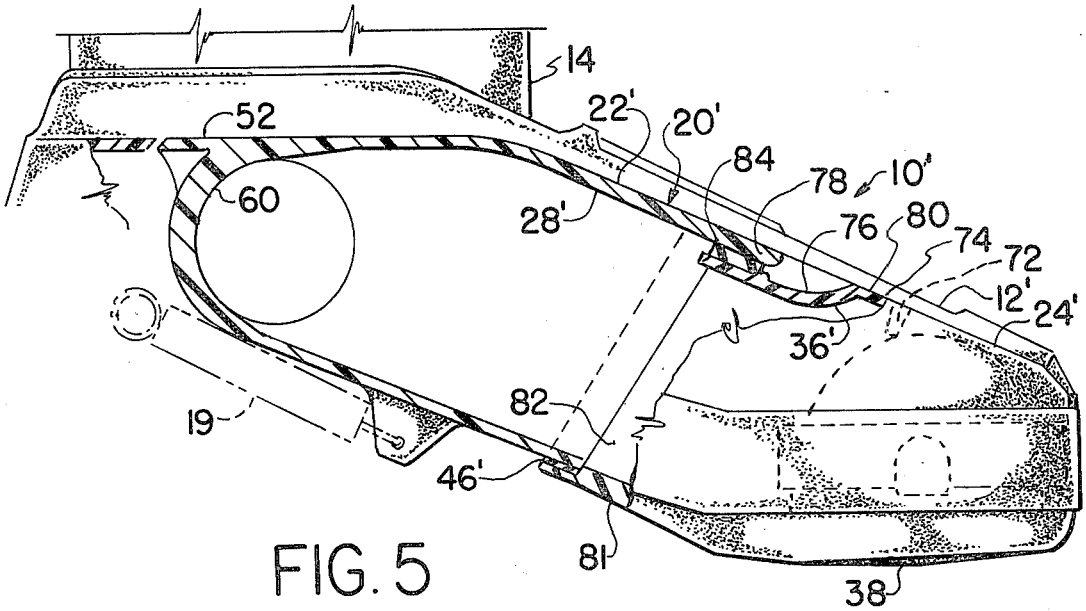
FIG. 5 is a cross sectional elevational view of the duct of FIG. 4.

Turning to FIGS. 4 and 5, it can be seen that a cleaner 10′ includes a hood 12′ and an upwardly extending rigid housing 14. An opening 21′ in hood 12′ permits the mounting of a pivoted duct 20′, with the same swinging out of the hood 12′, as shown in FIG. 4, for connection to a converter tool 26′.

The converter tool 26′ includes a locking tab 68 extending downwardly from its main body 70 so as to be engageable in a socket 72 formed in the hood 12′. This locks the converter tool 26′ to the cleaner 10′ for trundling purposes when conversion has been made.

The pivoted duct 20′ is mounted for confluent connection to the motor-fan system for swinging movement in the manner of the first embodiment. The pivoted duct 20′ is designed so that its top wall 28′ lies flush with the top wall 74 of the hood 12′, with a depression 76 in the hood 12′ permitting a finger hold to be obtained on the pivoted duct 20′ front portion 78 for pivoting it outwardly of the hood 12′.

As is seen, the fixed forward duct 36′ has a top wall 80 formed by the wall of the hood 12′ bounded by top surface 24′ of the hood 12′ which includes, with the top wall 80, a U-shaped, in cross section, three sided integral piece 82 forming all but the bottom of the fixed duct 36 which, in turn, is formed by a bottom plate 81. A gasket 46′ of U-shape provides the seal between the pivoted duct 20′ and the fixed forward duct 36′ to maintain a seal therebetween. The gasket 46′ extends high enough along the legs of the U-sided piece 82 to engage the bottom of the top side of top 22′ of duct 20′ with its ends.

The top surface 22′ of the pivoted duct 20′ is maintained flush with the top surface 24′ of top wall 80 by means of a spacer and seal, 84 attached to the top rear side of fixed duct 36′, beneath front portion 78, with the pivoted duct 20′ urged to this position by a tension spring 19 connected between the pivoted duct 20′ and lower reaches of the cleaner main body beneath the hood 12′. The gasket 46, of course, embraces the pivoted duct 20′ when it is confluent with fixed, forward duct 36′ to maintain it in communication with suction opening 38.

Figure 6:
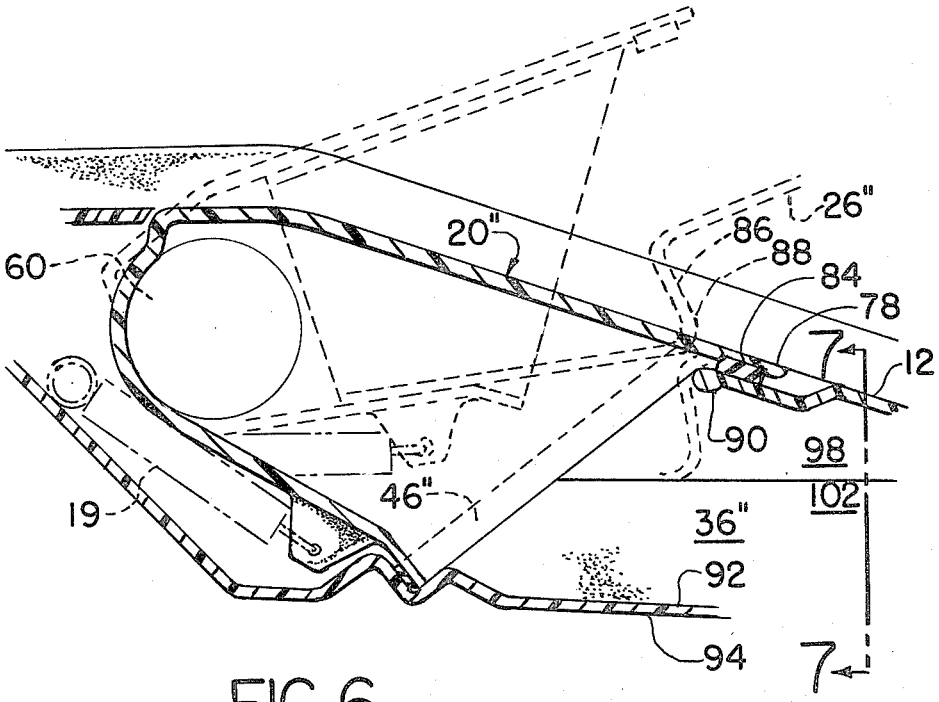
FIG. 6 is a cross sectional elevational view of a duct arrangement of a third embodiment.
Figure 8:
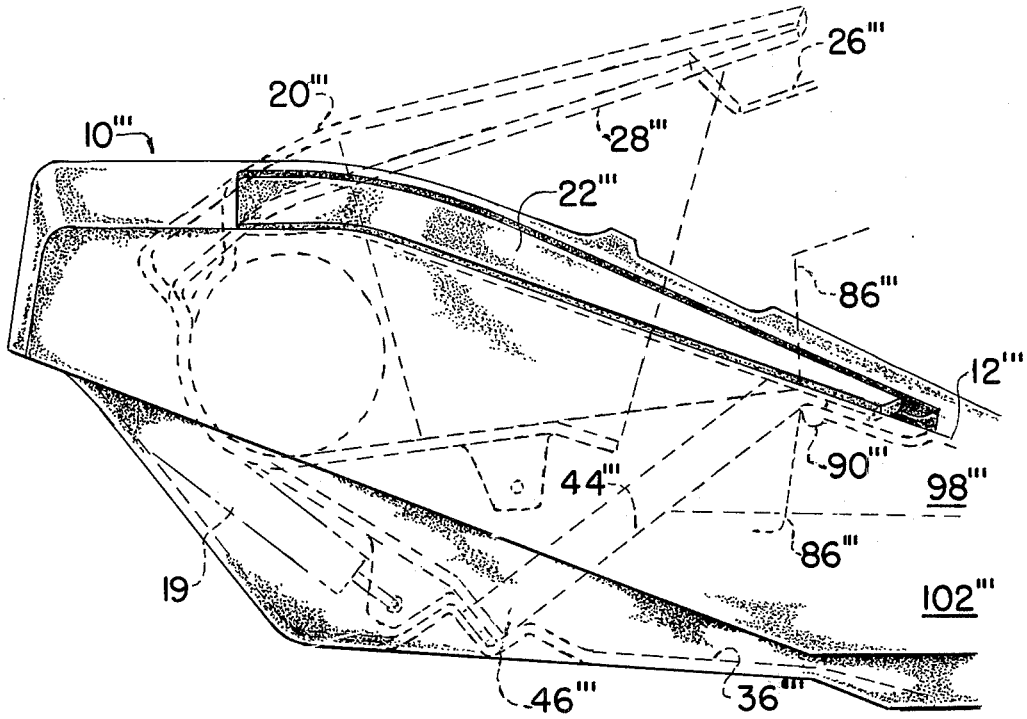
FIG. 8 is a view similar to FIG. 6 but showing a fourth and preferred embodiment of the invention.

A third embodiment of the invention is shown in FIG. 6, wherein a cleaner hood 12″ (shown fragmentarily) includes a pivoted duct 20″, pivoted in the manner of the first embodiment, having a spring 19 that urges the pivoted duct 20″ to closed position within hood 12″. At this location, the pivoted duct 20″ confluently communicates with a fixed, forward duct 36″, sealing being occasioned by a U-shaped gasket 46″.

Fixed forward duct 36″ may be formed partly by the hood 12″ and partly by a bottom wall 92 of cleaner bottom member 94, with the side walls of this duct, e.g., being formed by interengaging integral vertical walls 96, 98 and 100, 102, respectively, of the hood 12″ and cleaner bottom member 94. In many other respects, insofar as previously related, this species of the invention is quite similar to the first and second embodiments.

A finger piece or front portion 78, integral with the pivoted duct 20′, permits upward swinging of the pivoted duct 20″ so conversion of the cleaner 10″ may be had by insertion of converter tool 26″. The converter tool 26″ includes a bulbous portion 86 which affords a curved, hooked wall 88 disposed at the bottom of the converter tool 26″.

With the converter 26″ fully inserted into the pivoted duct 20″, such insertion being limited by the relative tapers of these two parts, the hooked portion 88 of bulbous portion 86 is located outwardly and forwardly of the pivoted duct 20″. In this position, upon downward swinging of the pivoted duct 20″ and converter tool 26″ as urged by spring 19, the hooked portion 88 moves behind a rearward lipped portion 90 of the fixed forward duct 36″. This locks the converter tool 26″ to the cleaner 10″ so that it and the cleaner 10″ may be trundled together.

In the fourth, and preferred embodiment of the invention, a cleaner 10‴ includes a pivoted duct 20‴, pivoted in the manner of the first embodiment and spring urged by spring 19 to confluent communication with a fixed forward duct 36‴. Movement of pivoted duct 20‴ upward for conversion purposes permits insertion of conversion tool 26‴ therein so that the cleaner 10‴ may be utilized for on the floor hose operation or the like. The fixed forward duct 36‴ may be constructed in the same manner as the third embodiment insofar as integral hood and bottom member parts are concerned and includes a lip 44‴ against which the pivoted duct seats.

The conversion tool 26‴ includes a bulbous portion 86‴ that resides behind a locking lip 90‴ on fixed forward duct 36‴ during conversion so that the cleaner 10‴ may be trundled for easy positioning of it.

The pivoted duct 20‴ includes a slanted top wall 22‴ forming a portion of the flow volume of the pivoting duct 20‴, proper. The slanted top wall 22, as in the second and third embodiments, then, forms a surface flush with the slanted remainder of the hood 12‴ to provide a trim look to the outward appearance of the cleaner 10‴. The conversion tool 26, of course, also includes a slanted top wall 96 to mate properly with pivoted duct 20‴.

It should be clear from the foregoing that the objects of the invention have been fully satisfied and, further, that many modifications to the invention may occur to one skilled in the art which would still fall within its spirit and purview.

What is claimed is:

1. A nozzle configuration including a covering hood wherein;

(a) a duct is disposed in said nozzle and pivotally mounted therein, (b) said duct pivoting out of said hood, and (c) the top surface of said duct, in recessed position, flush with the top surface of said hood.

2. The nozzle configuration of claim 1 wherein;

(a) said pivoted duct includes a finger contactable portion used to initiate pivoting of said pivoted duct.

3. A nozzle configuration including a convering hood wherein;

(a) a duct is disposed in said nozzle and pivotally mounted therein, (b) said duct pivoting out of said hood, and (c) said pivoted duct including an upper wall mounted to the duct having a surface flush with the top surface of said hood.

4. A nozzle configuration including;

(a) a duct, disposed in said nozzle, communicating with the fan of a motor-fan system for said nozzle, (b) said duct also communicating with a suction opening of said nozzle, (c) a converter coupling for attachment to said duct, (d) said duct pivoting upwardly away from said nozzle for conversion purposes and attachment to said converter coupling, and (e) said duct, in a non-pivoted position, having a top wall with a surface flush with a top surface of said nozzle.

5. The nozzle configuration of claim 4 wherein;

(a) said communication of said duct with said suction opening, formed by said duct substantially abutting end to end with a duct portion disposed forwardly of said duct in the suction opening direction.

* * * * *